US009456691B2

(12) United States Patent
Tang

(10) Patent No.: US 9,456,691 B2
(45) Date of Patent: Oct. 4, 2016

(54) STRUCTURE TO PREVENT DRAWER FROM FALLING OFF

(71) Applicant: Pao-Hsun Tang, Changhua (TW)

(72) Inventor: Pao-Hsun Tang, Changhua (TW)

(73) Assignee: MALZINE Co. Ltd., Changhua (TW)

( * ) Notice: Subject to any disclaimer, the term of this patent is extended or adjusted under 35 U.S.C. 154(b) by 0 days.

(21) Appl. No.: 14/280,580

(22) Filed: May 17, 2014

(65) Prior Publication Data

US 2015/0327678 A1 Nov. 19, 2015

(51) Int. Cl.

| | |
|---|---|
| ***A47B 88/00*** | (2006.01) |
| ***A47B 88/04*** | (2006.01) |
| ***A47B 88/16*** | (2006.01) |
| ***A47B 96/00*** | (2006.01) |
| *A47B 31/00* | (2006.01) |

(52) U.S. Cl.

CPC ..... *A47B 88/04* (2013.01); *A47B 88/16* (2013.01); *A47B 96/00* (2013.01); *A47B 88/0455* (2013.01); *A47B 2031/003* (2013.01); *A47B 2031/004* (2013.01)

(58) Field of Classification Search

CPC ..... Y10T 24/309; Y10T 24/44026; Y10T 16/628; Y10T 16/6285; Y10T 29/49876; A47B 2008/0448; A47B 88/12; A47B 2210/0059; A47B 2210/0018; A47B 2210/0024; A47B 88/16; A47B 2210/0081

USPC ..... 16/82, 86 R; 312/333, 334.44, 330.1, 312/334.18, 334.21

See application file for complete search history.

(56) References Cited

U.S. PATENT DOCUMENTS

| | | | | |
|---|---|---|---|---|
| 2,585,438 | A * | 2/1952 | Clingman | 16/86 A |
| 2,606,091 | A * | 8/1952 | Marion et al. | 312/334.16 |
| 4,186,979 | A * | 2/1980 | Litchfield | 312/333 |
| 4,190,306 | A * | 2/1980 | Litchfield et al. | 312/348.2 |
| 4,218,599 | A * | 8/1980 | Garn | F16F 1/00 16/86 R |
| 4,304,449 | A * | 12/1981 | Litchfield et al. | 312/334.18 |
| 4,384,746 | A * | 5/1983 | Ferdinand et al. | 384/21 |
| 4,795,041 | A * | 1/1989 | Remmers | 211/126.15 |
| 5,735,589 | A * | 4/1998 | Herrmann | B29C 33/123 108/102 |
| 6,015,053 | A * | 1/2000 | Sheng | 211/188 |
| 6,056,378 | A * | 5/2000 | Semon et al. | 312/246 |
| 6,216,892 | B1 * | 4/2001 | Grandclement | 211/186 |
| 7,963,408 | B2 * | 6/2011 | Glover | 211/126.15 |
| 8,960,822 | B1 * | 2/2015 | Hsu | 312/334.4 |
| 2004/0089625 | A1 * | 5/2004 | Tsai | 211/126.2 |
| 2008/0246377 | A1 * | 10/2008 | Huang | 312/334.8 |
| 2013/0063012 | A1 * | 3/2013 | Lu | 312/334.7 |

* cited by examiner

*Primary Examiner* — Janet M Wilkens

(74) *Attorney, Agent, or Firm* — Che-Yang Chen; Law Offices of Scott Warmuth

(57) ABSTRACT

A structure to prevent a drawer from falling off may include a rail and a stopping unit. The rail has an elongated side board, one side of the rail is extending to form a bottom board with an equal length as the side board. The bottom board has at least one through connecting opening. The stopping unit has a head portion, and one end of head portion has two pressing pieces, and a space formed between the two pressing pieces. When the pressing pieces move towards the space, the head portion is elastically deformed and plugged into the connecting opening of the rail. The stopping unit is configured to prevent the drawer from falling off if excessive force is applied thereon.

6 Claims, 7 Drawing Sheets

STRUCTURE TO PREVENT DRAWER FROM FALLING OFF

FIELD OF THE INVENTION

This invention relates to a rail structure for a drawer, and more particularly to an improved rail structure to prevent a drawer from falling off.

BACKGROUND OF THE INVENTION

Generally speaking, there will be rails at both sides of a rack and the rails are provided for the user to open the drawers at the rack. In order to reduce costs, a common rail is to utilize a long strip bending with two parallel boards, one of which is used for a drawer to be disposed against. However, while the cost of the common rail is low, the drawer may fall when there is excessive force applied on it, which is not only inconvenient, but also increasing the possibility to cause injury to the user. Thus, some rails will be equipped with a circular bumps or tapered protrusions to prevent the drawer from falling off due to excessive force applied thereon. However, the common rail may be disadvantageous because the round bumps or tapered protrusion may still be removed due to excessive force. If the number of the round bumps or tapered protrusions are increased, the drawer is hard to be removed. Therefore, there remains a need for a new and improved structure to prevent the drawer from falling off.

SUMMARY OF THE INVENTION

To solve the problem stated above, the present invention provides a structure to prevent a drawer from falling off that may include a rail and a stopping unit. The rail has an elongated side board, and one side of the side board is extending to form a bottom board with equal length as the side board. The bottom board has at least one through connecting opening. The stopping unit was made by a resilient plastic material and has one head portion, one end of which has two pressing pieces, and a space is formed between the two pressing pieces. When the pressing pieces move towards the space, the head portion will be elastically deformed and can be plugged at the connecting opening of the rail. A neck portion is formed between the stopping unit and the head portion, and the neck portion is disposed against the connecting opening to further secure the connecting opening and the head portion. The head portion has a guiding surface corresponding to an outer surface of the pressing piece, and the guiding surface is gradually expanding and leaning towards the pressing piece. With the guiding surface, it is easier to aim and insert the head portion into the connecting opening.

When in use, the rails are parallely set up on a rack with the side boards, and the rack is formed by at least one transverse board. The two rails are provided for a drawer that is configured to slide, and the drawer has a receiving space. An extension board is formed at an outer portion around the receiving space and the extension board has a supporting board formed toward a bottom surface of the drawer. The drawer is configured to slide on the bottom boards of the rails with the supporting boards on both sides thereof, and the head portion of the stopping unit is located at an inner portion of the supporting board, so the drawer does not fall off due to overweight nor excessive force.

Comparing with conventional arts, the present invention is advantageous because (i) the pressing pieces of the stopping unit are provided for the user to press through the space to deform the head portion of the stopping unit, so the head portion can be plugged into the connecting opening of the rail to stop the drawer from falling off, and when the user wants to pull out the drawer, he/she can press the pressing piece to remove the stopping unit from the connecting opening, and the drawer can be further pulled out; and (ii) the stopping unit is plugged at the bottom board of the rail through the head portion and the neck portion is used to secured the stopping unit and the connecting opening. In other words, the stopping unit is configured to prevent the drawer 40 from falling off if excessive force is applied thereon.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
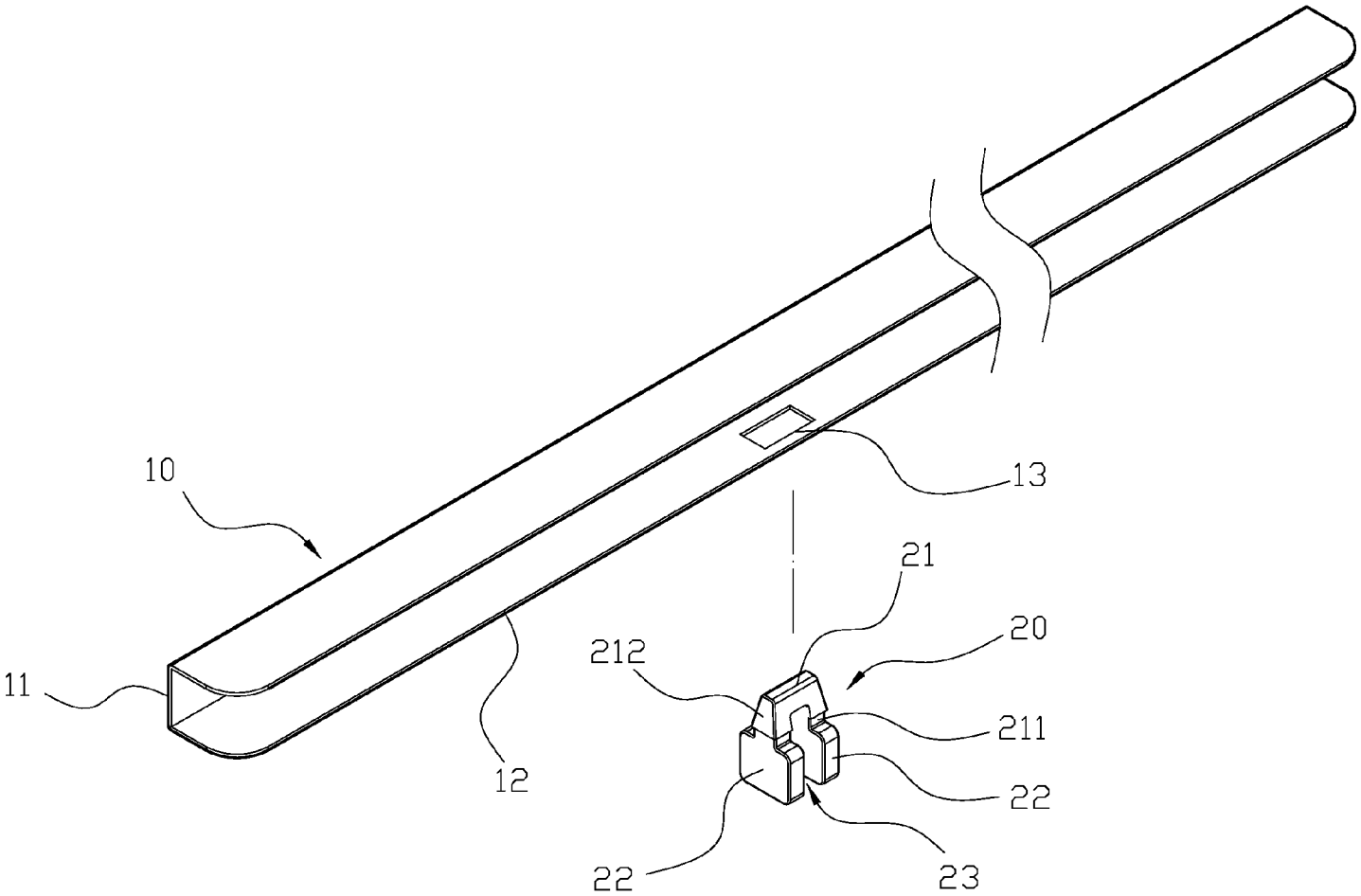
FIG. 1 illustrates a three-dimensional view of the rails and stopping unit in the present invention.
Figure 2:
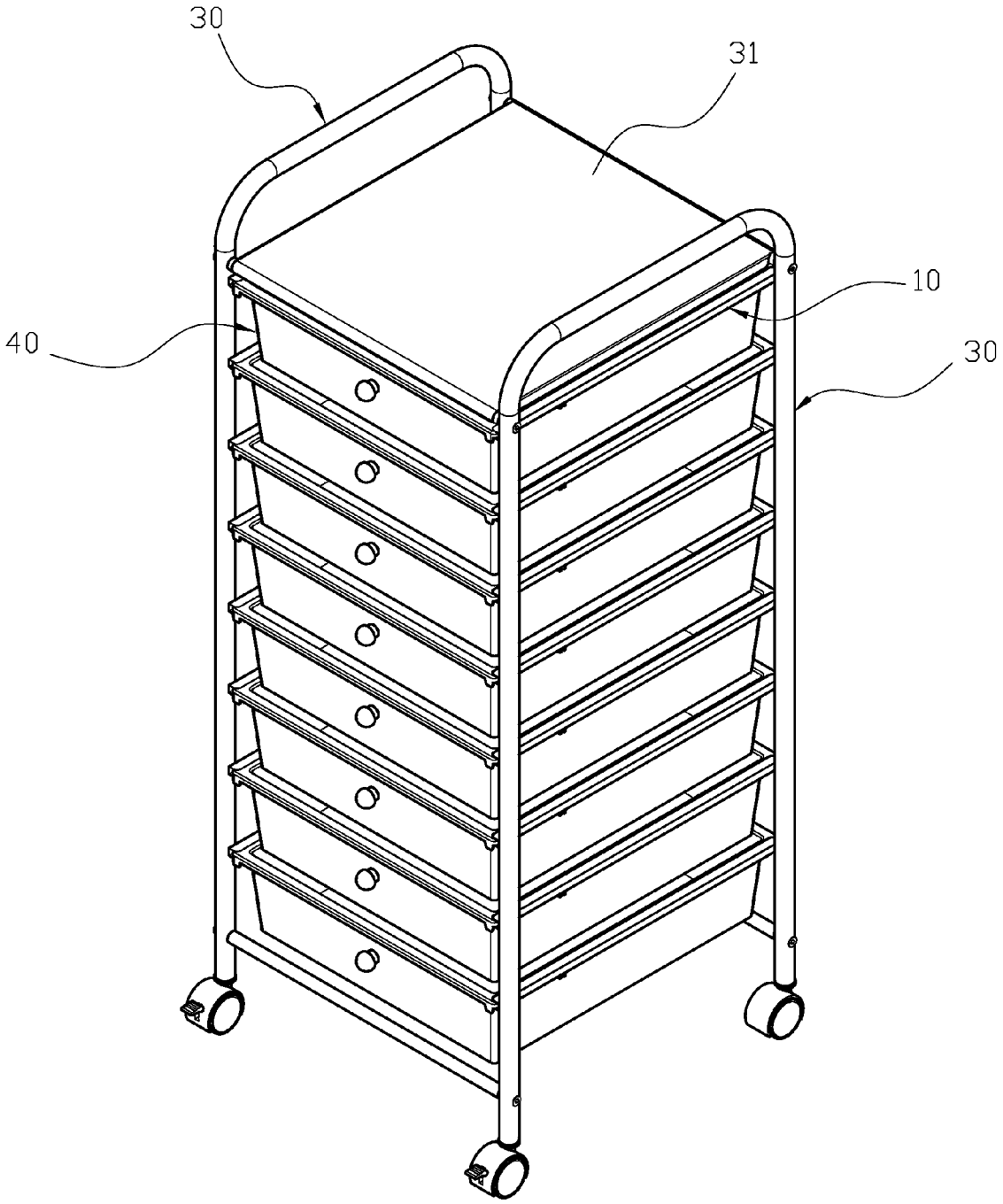
FIG. 2 illustrates a three-dimensional view of the rack in the present invention.
Figure 3:
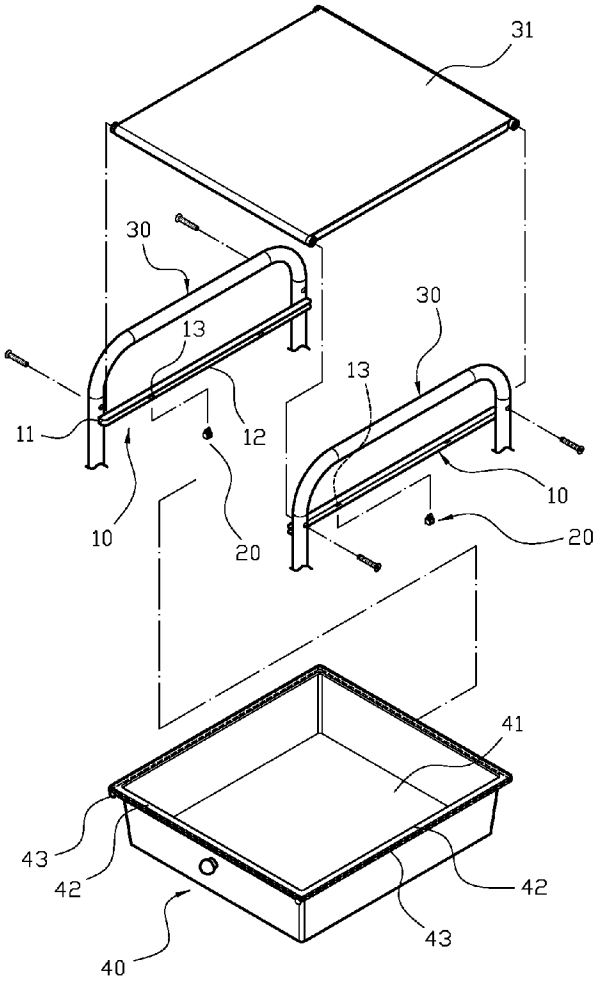
FIG. 3 illustrates an exploded view of the rack in the present invention.
Figure 4:
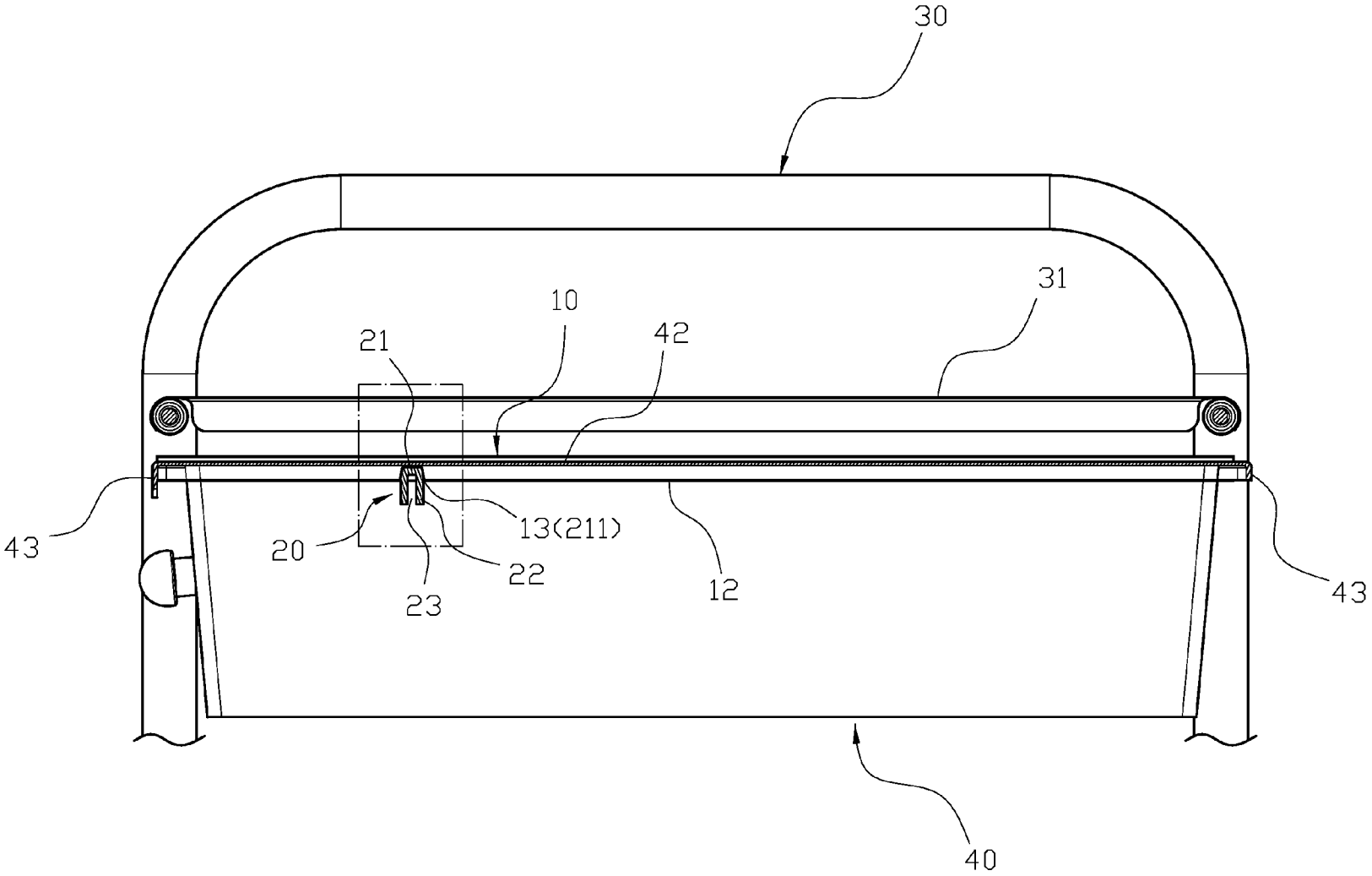
FIG. 4 illustrates a sectional view in the present invention.
Figure 7:
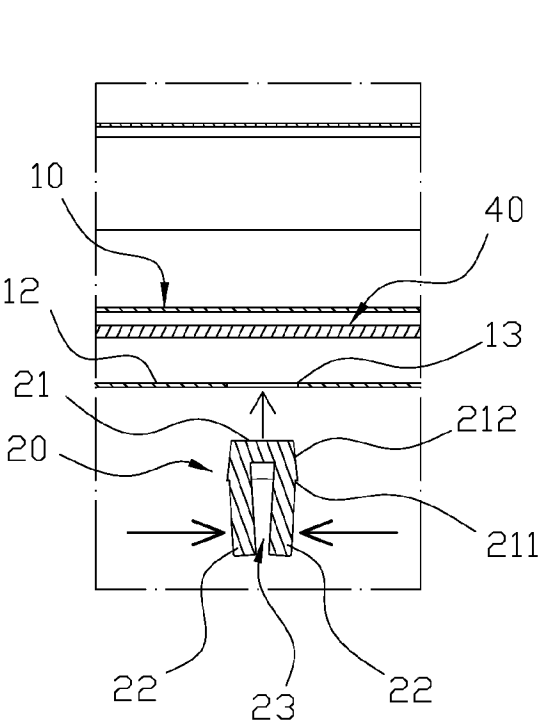
FIG. 7 illustrates a third enlarged sectional view of FIG. 4 in the present invention.
Figure 6:
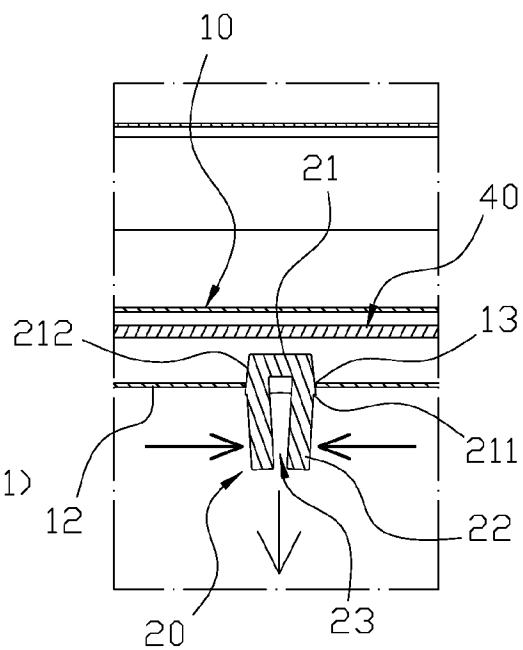
FIG. 6 illustrates a second enlarged sectional view of FIG. 4 in the present invention.
Figure 5:
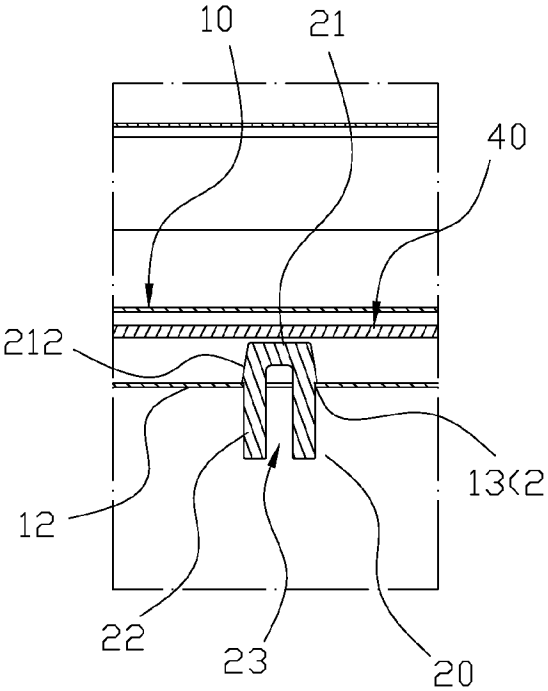
FIG. 5 illustrates a first enlarged sectional view of FIG. 4 in the present invention.
Figure 8:
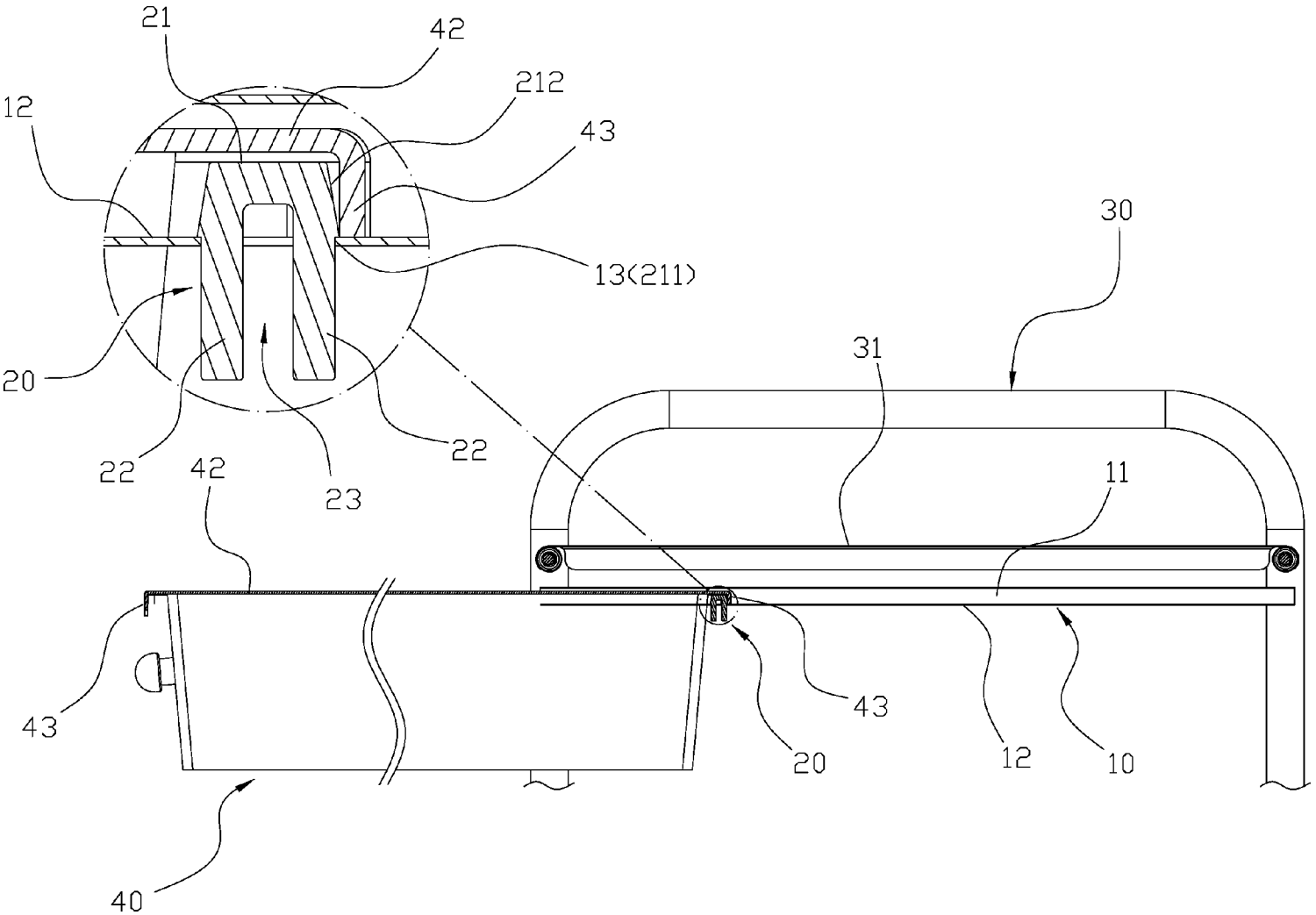
FIG. 8 is a first schematic view of the present invention when in use.

In order to further understand the goal, characteristics and effect of the present invention, a number of embodiments along with the drawings are illustrated as following:

Referring FIG. 1, a structure to prevent a drawer from falling off may include a rail 10 and a stopping unit 20. The rail 10 has an elongated side board 11, and one side of the side board 11 is extending to form a bottom board 12 with equal length as the side board 11. The bottom board 12 has at least one through connecting opening 13. The stopping unit 20 was made by a resilient plastic material and has one head portion 21, one end of which has two pressing pieces 22, and a space 23 is formed between the two pressing pieces 22. When the pressing pieces 22 move towards the space 23, the head portion 21 will be elastically deformed and can be plugged at the connecting opening 13 of the rail 10. A neck portion 211 is formed between the stopping unit 20 and the head portion 21, and the neck portion 211 is disposed against the connecting opening 13 to further secure the connecting opening 13 and the head portion 21. The head portion 21 has a guiding surface 212 corresponding to an outer surface of the pressing piece 22, and the guiding surface 212 is gradually expanding and leaning towards the pressing piece 22. With the guiding surface 212, it is easier to aim and insert the head portion 21 into the connecting opening 13.

When in use, referring to FIGS. 1 to 5, the rails 10 are parallely set up on a rack 30 with the side boards 11, and the rack 30 is formed by at least one transverse board 31. The two rails 10 are provided for a drawer 40 that is configured to slide, and the drawer 40 has a receiving space 41. An extension board 42 is formed at an outer portion around the receiving space 41 and the extension board 42 has a supporting board 43 formed toward a bottom surface of the drawer 40. The drawer 40 is configured to slide on the bottom boards 12 of the rails 10 with the supporting boards 43 on both sides thereof, and the head portion 21 of the stopping unit 20 is located at an inner portion of the supporting board 43, so the drawer 40 does not fall off due to overweight nor excessive force.

Figure 9:
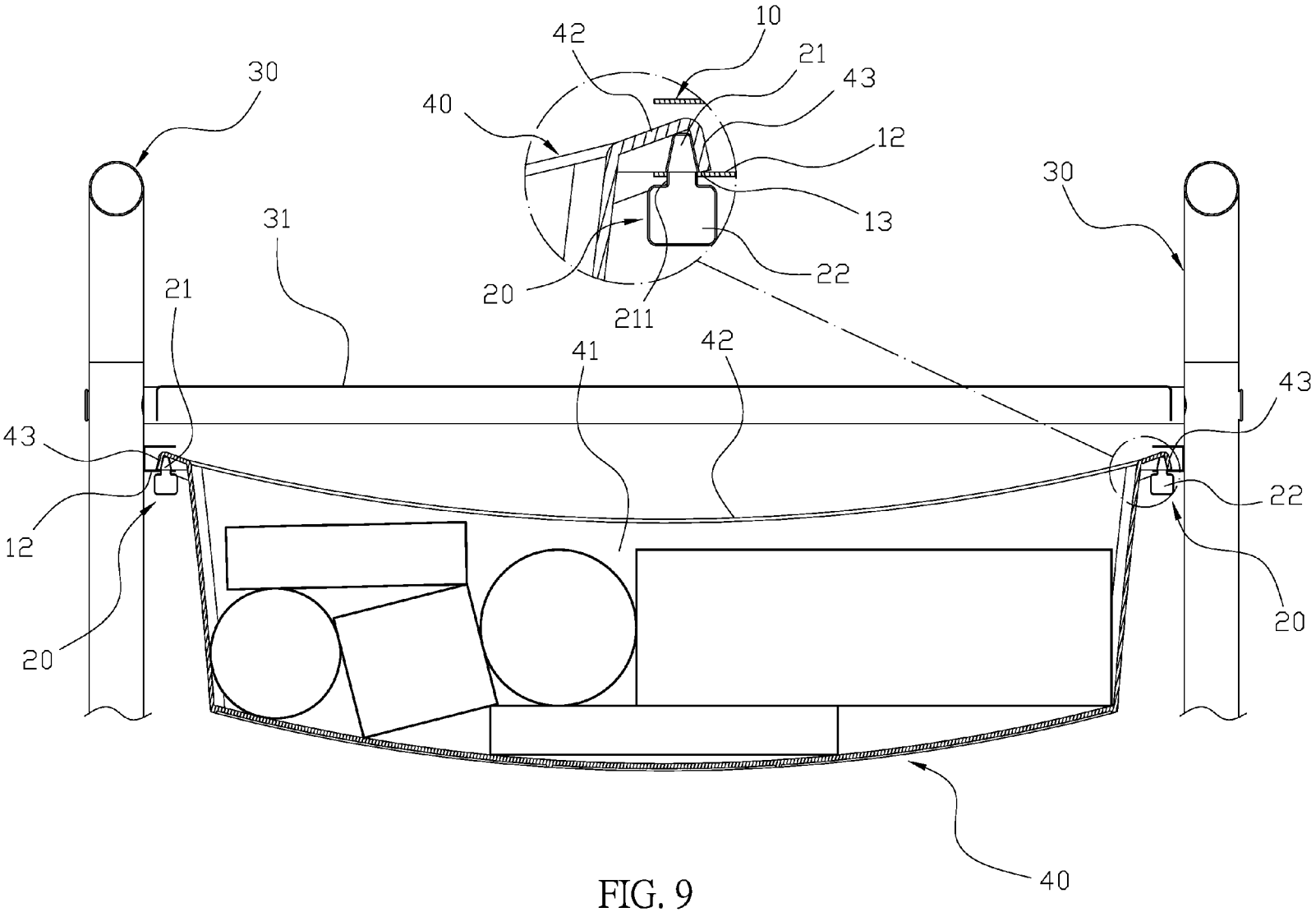
FIG. 9 is a second schematic view of the present invention when in use.

Furthermore, referring to FIGS. 5 to 8, the pressing pieces 22 of the stopping unit 20 are provided for the user to press through the space 23 to deform the head portion 21 of the stopping unit 20, so the head portion 21 can be plugged into the connecting opening 13 of the rail 10 and the supporting board 43 of the drawer 40 can be stopped by the stopping unit 20, and the drawer 40 cannot be pulled out from the rails 10. When the user wants to pull out the drawer 40, he/she can press the pressing piece 22 to remove the stopping unit 20 from the connecting opening 13, and the drawer 40 can be further pulled out. When the receiving space 41 of the drawer 40 contains overweigh objects, as shown in FIG. 9, the bottom structure of the drawer 40 is deformed and the extension board 42 is bent and shrunk inwardly. Meanwhile, the head portion 21 of the stopping unit 20 is blocked the inner portion of the supporting board 43 to prevent the drawer 40 from falling off because of the overweight objects.

According to the embodiments discussed above, the present invention is advantageous because (i) the pressing pieces 22 of the stopping unit 20 are provided for the user to press through the space 23 to deform the head portion 21 of the stopping unit 20, so the head portion 21 can be plugged into the connecting opening 13 of the rail 10 to stop the drawer 40 from falling off, and when the user wants to pull out the drawer 40, he/she can press the pressing piece 22 to remove the stopping unit 20 from the connecting opening 13, and the drawer 40 can be further pulled out; and (ii) the stopping unit 20 is plugged at the bottom board 12 of the rail 10 through the head portion 21 and the neck portion 211 is used to secured the stopping unit 20 and the connecting opening 13. In other words, the stopping unit 20 is configured to prevent the drawer 40 from falling off if excessive force is applied thereon.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A structure to prevent a drawer from falling off comprising:

a pair of rails, each rail having an elongated side board, one side of each side board extending to form a bottom board with an equal length as the side board, and each bottom board having at least one through connecting opening; and a stopping unit having a head portion that is slightly smaller than said connecting opening, two separate pressing pieces extending from one end of the head portion, and a reverse U-shaped space with an opened end formed between the two pressing pieces, so when the pressing pieces move towards the reverse U-shaped space, the head portion is elastically deformed and plugged into each connecting opening of the rail.

2. The structure to prevent a drawer from falling off of claim 1, wherein a neck portion is between the pressing pieces and the head portion, and the neck portion is disposed against the connecting opening to further secure the connecting opening and the head portion.

3. The structure to prevent a drawer from falling off of claim 1, wherein the head portion has a guiding surface corresponding to an outer surface of each of the pressing pieces, and the guiding surface is gradually expanding and leaning towards the pressing piece to facilitate the head portion to plug into the connecting opening.

4. The structure to prevent a drawer from falling off of claim 1, wherein the stopping unit is made by elastic plastic materials.

5. The structure to prevent a drawer from falling off of claim 1, wherein the rails are parallely set up on a rack with the side boards, and the rack is formed by at least one transverse board, and the two rails are provided for a drawer to slide thereon.

6. The structure to prevent a drawer from falling off of claim 5, wherein a drawer has a receiving space, and an extension board is formed at an outer portion around the receiving space, and the extension board has a supporting board formed toward a bottom surface of the drawer, wherein the drawer is configured to slide on the bottom boards of the rails with the supporting boards on both sides thereof, and the head portion of the stopping unit is located at an inner portion of the supporting board to prevent the drawer from falling off due to overweight or excessive force.

* * * * *